US005695631A

United States Patent [19]

Eguchi et al.

[11] Patent Number: 5,695,631

[45] Date of Patent: Dec. 9, 1997

[54] PROCESS FOR PRODUCING PETROLEUM NEEDLE COKE

[75] Inventors: Junji Eguchi; Hiroichi Miyasaka, both of Tokyo; Masami Kinouchi, Okhawa-gun; Yoichi Ohashi, Ayauta-gu; Takeshi Hori, Sakaide; Yuji Yamamura, Ayauta, all of Japan

[73] Assignee: Mitsubishi Chemical Corporation, Japan

[21] Appl. No.: 71,637

[22] Filed: Jun. 4, 1993

[51] Int. Cl.[6] ..... C10G 57/00

[52] U.S. Cl. ..... 208/50; 208/131; 208/132; 208/44

[58] Field of Search ..... 208/39, 22, 50, 208/131, 132, 44

[56] References Cited

U.S. PATENT DOCUMENTS

| | | | |
|---|---|---|---|
| 4,111,794 | 9/1978 | Pietzka et al. | 208/131 |
| 4,289,604 | 9/1981 | Kölling et al. | 208/106 |
| 4,664,774 | 5/1987 | Chu et al. | 208/22 |
| 4,997,542 | 3/1991 | Couderc et al. | 208/39 |
| 5,128,021 | 7/1992 | Romey et al. | 208/22 |
| 5,143,689 | 9/1992 | Hauser et al. | 436/149 |

*Primary Examiner*—Helane Myers

*Attorney, Agent, or Firm*—Nixon & Vanderhye

[57] ABSTRACT

Disclosed herein are a process for producing needle coke, which comprises reducing the ash content in a heavy oil obtained from fluid catalytic cracking of petroleum or in a hydrocarbon material mainly composed of said heavy oil to not more than 0.01 wt % by means of (1) filtration, (2) centrifugation, (3) electrostatic aggregation or (4) a combination thereof, and coking the thus treated heavy oil or hydrocarbon material with an ash content of not more than 0.01 wt %; and a needle coke produced by coking a heavy oil obtained from fluid catalytic cracking of petroleum or a hydrocarbon material mainly composed of said heavy oil.

7 Claims, No Drawings

PROCESS FOR PRODUCING PETROLEUM NEEDLE COKE

BACKGROUND OF THE INVENTION

The present invention relates to a process for producing petroleum needle coke which is low in thermal expansion coefficient.

Recently, a demand has been rising for providing needle coke with a low thermal expansion coefficient to suit with the certain use conditions of electrodes.

Researches for meeting this demand had been carried out and as a result, needle coke having a lower thermal expansion coefficient than that of the conventional petroleum needle coke could be produced by removing quinoline insolubles from coal tar or coal tar pitch.

However, increasing harshness of the use conditions of electrodes has enhanced the necessity for needle coke having an even lower thermal expansion coefficient. Various attempts for lowering the thermal expansion coefficient, for example, attempts for producing needle coke having a lower thermal expansion coefficient than that of coal needle coke by using petroleum materials have been conducted. Nevertheless, none of the proposed methods and techniques have been successful in terms of practical use, and there has yet been offered no commercial petroleum needle coke having a lower thermal expansion coefficient than that of coal needle coke.

In the fluid catalytic cracking decant oil (hereinafter abbreviated as FCC decant oil) used as starting material in preparation of petroleum needle coke, there is contained usually about 0.02 to 0.03 wt % (200 to 300 ppm) or more of "ash", that is, fluid catalytic cracking catalyst (hereinafter abbreviated as FCC catalyst) such as silica-alumina catalyst, etc. Namely, it is known that the needle coke obtained from an FCC decant oil retaining an FCC catalyst in a high content is poor in properties such as thermal expansion coefficient. Therefore, it has been tried to remove the FCC catalyst from the FCC decant oil by suitable means such as static separation, etc. to reduce the FCC catalyst content to the above-mentioned range of about 200 to 300 ppm, and to thus treated FCC decant oil has been used as starting material for preparation of petroleum needle coke. However, the obtained needle coke was not sufficiently low in thermal expansion coefficient.

Thus; the establishment of a process for easy commercial production of petroleum needle coke with a low thermal expansion coefficient and high quality has been demanded.

As the result of the present inventors earnest researches on the subject matter, it has been found that the FCC catalyst detrimental to thermal expansion coefficient in the FCC decant oil can be easily removed by means of (1) filtration, (2) centrifugation and/or (3) electrostatic aggregation, and by using this treated PCC decant oil, needle coke having a thermal expansion coefficient equal to or smaller than that of coal needle coke can be obtained. The present invention was achieved on the basis of this finding.

SUMMARY OF THE INVENTION

An object of the present invention is to provide an industrial process for producing easily and simply petroleum needle coke with a low thermal expansion coefficient and high quality.

An another object of the present invention is to provide petroleum needle coke with a low thermal expansion coefficient and high quality.

In a first aspect of the present invention, there is provided a process for producing needle coke, which comprises reducing the ash content in a heavy oil obtained from fluid catalytic cracking of petroleum or in a hydrocarbon material mainly composed of the said heavy oil to 0.01 wt % or less by means of (1) filtration, (2) centrifugation, (3) electrostatic aggregation or (4) combination thereof, and coking the thus treated heavy oil or hydrocarbon material with an ash content of not more than 0.01 wt. %.

In a second aspect of the present invention, there is provided a process for producing needle coked which comprises reducing the ash content in a heavy oil obtained from fluid catalytic cracking of petroleum or in a hydrocarbon material mainly composed of the said heat oil to 0.01 wt % or less by means of (1) filtration, (2) centrifugation, (3) electrostatic aggregation or (4) a combination thereof, mixing the thus obtained heavy oil or hydrocarbon material having an ash content of not more than 0.01 wt % with a coal-tar heavy oil substantially free of quinoline insolubles, and coking the resulting mixture.

In a third aspect of the present invention, there is provided needle coke produced by the process set forth in the first aspect of the invention.

In a fourth aspect of the present invention, there is provided needle coke produced by the process set forth in the second aspect of the invention.

DETAILED DESCRIPTION OF THE INVENTION

The FCC decant oil used as a starting material in preparation of petroleum needle coke in the present invention is an oil which is obtained as a by-product in the process of production of gasoline, LPG or the like through catalytic cracking of petroleum fractions such as light oil by use of a granulated catalyst.

The "hydrocarbon material mainly composed of FCC decant oil", which is also usable as starting material of petroleum needle coke in the present invention, is a product obtained by mixing a hydrolysis oil, normal-pressure residual oil, reduced-pressure residual oil, coal tar, coal tar pitch and/or other organic materials with an FCC decant oil in a ratio of 30 to 90 parts by weight, preferably 40 to 80 parts by weight based on 100 parts by weight of the said FCC decant oil.

As the methods usable for removing ash (reducing the ash content) in the present inventions (1) filtration and (2) centrifugation and/or (3) electrostatic aggregation may be exemplified.

(1) The filtration mentioned above is a method in which an FCC decant oil or a hydrocarbon material mainly composed of the FCC decant oil (hereinafter referred to as starting material), which has been heated to a temperature of 100° to 300° C., preferably 150° to 250° C., is passed through a membrane filter with a mesh size of not more than 3 μm, preferably 0.1 to 1 μm under a pressure of 1 to 5 $kg/cm^2G$, preferably 1 to 3 $kg/cm^2G$.

It is preferable to reduce the viscosity of the starting material for increasing filtration efficiency. But, when the starting material is heated to a temperature of more than 300° C., the internal disturbance may be caused in the starting material. Also when the heating temperature is less than 100° C., the viscosity of the starting material may elevate, thereby lowering the filtration efficiency. Still more, when the pressure applied for filtration is less than 1 $kg/cm^2G$, the ash-filtering efficiency becomes low. When the pressure exceeds 5 $kg/cm^2G$, some ash may be allowed to pass through the filter, resulting in incomplete filtration. When the mesh size of the membrane is greater than 3 μm, some ash may also be allowed to pass through the filter to cause unsatisfactory filtration.

(2) In the centrifugation, the starting material heated to a temperature of 100° to 300° C. preferably 150° to 250° C. is centrifuged under a centrifuging force of not less than 7,000 G, preferably 8,000 to 10,000 G, at a temperature of 100 to 300 to separate ash. When the centrifuging force applied is less thin 7,000 G, the ash removing efficiency is unacceptably low. The centrifuging temperature exceeding 300° C. is undesirable in view of durability of the centrifuge and probability of causing internal disturbance in the material.

(3) The electrostatic aggregation is a method in which a voltage is applied to the ash particle as such as catalyst particles contained in the starting material to electrically charge them, so that they aggregate with each other; and the resultant aggregates are removed from the starting material by a known means.

An example of this method is described below. At least two electrode plates having a sufficient surface area are disposed with a spacing of 1 to 1,000 mm, preferably 50 to 300 mm between the electrode plates, and a voltage of 1 to 100 kV, preferably 5 to 30 kV is applied across the electrode plates. Then the starting material heated to a temperature of 100° to 300° C., preferably 150° to 250° C. is passed between the electrode plates to electrically charge and aggregate the ash particles such as fine catalyst particles contained therein with each other. The thus treated material is subjected to the above-described filtration and/or centrifugation to remove ash.

When the spacing between the electrode plates exceeds 1,000 mm or when the voltage applied is less than 1 kV, electric charging and aggregation of the ash particles are insufficient, resulting in unsatisfactory ash removal. Also, when the distance between the electrode plates is less than 1 mm, the starting material is unable to pass between the plates. Application of a voltage exceeding 100 kV causes internal disturbance (phenomenon of bubble generation by volatilization of low boiling-point materials) in the material.

For effecting efficient aggregation and removal of the ash particles such as fine catalyst particles in the starting material, it is preferable to lower the viscosity of the material by heating. However, heating more than 300° C. is undesirable as it may cause internal disturbance in the material. Addition of a light oil such as naphthalene oil and creosote oil is also a recommendable method for lowering the viscosity of the starting material.

As a result of the above ash removing treatment, the ash content in the starting material is reduced to not more than 0.01 wt %, preferably not more than 0.005 wt %, more preferably not more than 0.002 wt %.

The thus treated material is charged into a delayed coker and coked therein at a temperature of 450° to 500° C. to obtain green coke. This green coke is calcined at a temperature of 1,200° to 1,500° C. by using a rotary kiln, rotary hearth electric furnace, shaft kiln or the like to obtain needle coke.

A coal-tar heavy oil substantially free of quinoline insolubles may be mixed with the above treated starting material having an ash content of not more than 0.01 wt % in an amount of 30 to 95 parts by weight, preferably 40 to 80 parts by weight based on 100 parts by weight of the starting material to prepare a coking raw material.

Typical examples of the coal-tar heavy oil are ordinary coal tar which is generated as a by-product in the process of coke production and coal tar pitch with a softening point of not more than 100° C.

The "substantially free of quinoline insolubles" means that the content of the quinoline insolubles is not more than 0.1 wt %. The known methods (such as disclosed in DE 2638992) can be applied for removing the quinoline insolubles from the coal tar heavy oil.

The thermal expansion coefficient of the electrode produced from the needle coke obtained in the manner described above is not mote than $5.5\times10^{-7}$/°C., preferably not more than $5.3\times10^{-7}$/°C., more preferably not more than $4.9\times10^{-7}$/°C.

The needle coke obtained according to the process of the present invention is useful as an electrode material Because of its small thermal expansion coefficient.

EXAMPLES

The present invention is further described below with reference to the embodiments thereof.

The thermal expansion coefficient was determined in the following way. The calcined coke was adjusted in particle size and added with 2% of iron oxide as inhibitor, and after one-hour mixing by a kneeder, the resultant mixture was molded into a labo-electrode, which was then calcined at a temperature of 1,000° C. and further subjected to a graphitizing treatment at a temperature of 2,800° C. The thermal expansion coefficient of the resulting product was measured.

Example 1

An FCC decant oil (ash content:0.024 wt %) was heated to a temperature of 150° C. and passed through a membrane filter having 0.5 μm of a membrane size under a pressure of 4 kg/cm$^2$G remove ash. The resulting FCC decant oil was coked in an autoclave at a temperature of 500° C. for 24 hours under a pressure of 3 kg/cm$^2$G and calcined at a temperature of 1,400° C. The results are shown in Table 1.

Example 2

An FCC decant oil (ash content: 0.024 wt %) was heated to a temperature of 100° C. and centrifuged by a self-discharging-type disc centrifuge with a centrifugal force of 10,000 G (G means g·cm/sec$^2$) to remove ash. The resulting FCC decant oil was coked in the same way as in Example 1. The results are shown in Table 1.

Example 3

An FCC decant oil (ash content: 0.024 wt %) was passed between the electrode plates, across which a voltage of 10 kV has been applied, at a flow rate of 6.1/min and then treated by a self-discharging type disc centrifuge with a centrifugal force of 7,000 G to remove ash. The resulting decant oil was coked after the manner of example 1. The

Example 4

An FCC decant oil from which ash has been removed by the same method as used in Example 1 was mixed with a coal tar pitch having a softening point of 40° C. and a solvent (a mixture of kerosene and an aromatic oil) having a solubility index of 70 (mixing ratio=1:0.6). Then a coal tar pitch from which the quinoline insolubles have been removed by static separation (at a temperature of 250° C.) and then the solvent has been distilled away was mixed in the ratios shown in Table 2, and each mixture was coked in the same way as in Example 1. The results are shown in Table 2.

Comparative Example 1

An FCC decant oil (ash content: 0.024 wt %) from which ash has not been removed was coked in the same way as in Example 1.

Comparative Example 2

A coal tar pitch from which the quinoline insolubles have been removed by the method of Example 4 was coked in the same way as in Example 1.

TABLE 1

| | Comp. Example 1 | Example 1 | Example 2 | Example 3 |
|---|---|---|---|---|
| Ash removing method | Ash unremoved | Filtration | Centrifugation | Electrostatic aggregation |
| Ash content (%) | 0.024 | 0.001 | 0.004 | 0.002 |
| Thermal expansion coefficient ($*10^{-7}$° C.$^{-1}$) | 6.7 | 4.8 | 5.2 | 4.9 |
| Puffing (%) (1700–2600° C.) | 0.82 | 0.86 | 0.85 | 0.85 |

(Note) Puffing means a ratio of an irreversible expansion of a baked electrode containing needle coke in the production of graphite electrodes. The Puffing is shown by elongation (%) of a baked electrode in a direction vertical to the machine direction at a temperature of 1,700 to 2,600° C.

TABLE 2

| | Coal tar pitch:petroeum heavy oil | | | | |
|---|---|---|---|---|---|
| Mixing ratio | 100:0 | 75:25 | 50:50 | 25:75 | 0:100 |
| Ash content (%) | 0.003 | 0.003 | 0.002 | 0.001 | 0.001 |
| Thermal expansion coefficient ($*10^{-7}$° C.$^{-1}$) | 5.5 | 5.3 | 51 | 4.9 | 4.8 |
| Puffing (%) (1700–2600° C.) | 0.71 | 1.47 | 1.21 | 1.02 | 0.86 |

Example 5

An FCC decant oil was heated to a temperature of 100° C. and then treated by a self-discharging type disc centrifuge at a speed of 8,000 G. (corresponding to a centrifuging force of G) to remove ash. The thus treated FCC decant oil was mixed with a coal tar pitch having a softening point of 40° C. and a solvent (a mixture of kerosene and an aromatic oil) having a solubility index of 70 (mixing ratio=1:0.6). Then a coal tar pitch from which the quinoline insolubles have been removed by static .separation (at a temperature of 250° C.) and then the solvent has been distilled away was mixed in the ratios shown in Table 3, and each mixture was coked by a delayed coker at a temperature of 500° C. under a pressure of 3.5 kg/cm$^2$G for 24 hours and then calcined by a rotary kiln at a temperature of 1,500° C. The results are shown in Table 3.

TABLE 3

| | Coal tar pitch:petoleum heavy oil | | |
|---|---|---|---|
| Mixing ratio | 75:25 | 50:50 | 25:75 |
| Ash content (%) | 0.003 | 0.002 | 0.001 |
| Thermal expansion coefficient ($*10^{-7}$° C.$^{-1}$) | 3.5 | 3.6 | 3.8 |

TABLE 3-continued

| | Coal tar pitch:petoleum heavy oil | | |
|---|---|---|---|
| Mixing ratio | 75:25 | 50:50 | 25:75 |
| Puffing (%) (1700–2600° C.) | 1.41 | 1.24 | 1.00 |

What is claimed is:

1. A process for producing needle coke comprising the steps of:
   (1) reducing the ash content in a heavy oil obtained from fluid catalytic cracking of petroleum or in a hydrocarbon material mainly composed of said heavy oil to not more than 0.01 wt % by:
      (a) filtration which is carried out by passing the heavy oil or hydrocarbon material heated to a temperature of 100° to 300° C. through a membrane filter with a mesh size of not greater than 3 μm under a pressure of 1 to 5 kg/cm$^2$,
      (b) centrifugation which is carried out with a centrifugal force of not less than 7,000 G at a temperature of 100° to 300° C.,
      (c) electrostatic aggregation which is carried out by passing the heavy oil or hydrocarbon material between at least two electrode plates spaced-apart from each other by a distance of 1 to 1,000 mm, under a voltage of 1 to 100 kV applied across and a temperature of 100° to 300° C., or
      (d) a combination thereof, and thereafter
   (2) coking the thus-treated heavy oil or hydrocarbon material with an ash content of not more than 0.01 wt % to produce needle coke.

2. A process according to claim 1, wherein said heavy oil or hydrocarbon material with an ash content of not more than 0.01 wt % is mixed with a coal tar heavy oil having a quinoline insoluble content or not more than 0.1 wt %, and the resulting mixture is coked.

3. A process according to claim 1, wherein the coked material is calcined at a temperature of 1,200° to 1,500° C.

4. A process according to claim 1, wherein the amount of the coal tar heavy oil is 30 to 95 parts by weight based on 100 parts by weight of the treated heavy oil or hydrocarbon material.

5. A process according to claim 1, wherein the ash content of the treated heavy oil or hydrocarbon material is not more than 0.005 wt %.

6. A process according to claim 5, wherein the ash content is not more than 0.002 wt %.

7. A process for producing needle coke comprising the steps of:
   (1) reducing the ash content in a heavy oil obtained from fluid catalytic cracking of petroleum or in a hydrocarbon material mainly composed of said heavy oil to not more than 0.01 wt % by (i) centrifugation which is carried out with a centrifugal force of not less than 7,000 G at a temperature of 100° to 300° C., (ii) electrostatic aggregation which is carried out by passing the heavy oil or hydrocarbon material between at least two electrode plates spaced-apart from each other by a distance of 1 to 1,000 mm, under a voltage of 1 to 100 kV applied across and a temperature of 100° to 300° C., or (iii) a combination of (i) and (ii) thereof, and thereafter
   (2) coking the thus-treated heavy oil or hydrocarbon material with an ash content of not more than 0.01 wt % to produce needle coke.

* * * * *